US005861711A

United States Patent [19]

Kim et al.

[11] Patent Number: 5,861,711

[45] Date of Patent: Jan. 19, 1999

[54] DEFLECTION YOKE MOUNTING DEVICE OF THE SPRAY

[75] Inventors: Soon-Dong Kim; Seon-Kyu Park, both of Kyungki-do, Rep. of Korea

[73] Assignee: SamSung Electronics Co., Ltd., Kyungki-do, Rep. of Korea

[21] Appl. No.: 829,134

[22] Filed: Mar. 28, 1997

[30] Foreign Application Priority Data

Mar. 28, 1996 [KR] Rep. of Korea ..... 6253/1996
May 2, 1996 [KR] Rep. of Korea ..... 10498/1993

[51] Int. Cl.[6] ..... H01J 29/70

[52] U.S. Cl. ..... 313/440; 335/210; 335/213

[58] Field of Search ..... 313/440, 431, 313/413, 433, 479; 335/210, 213; 348/829, 830, 831

[56] References Cited

U.S. PATENT DOCUMENTS

| | | | |
|---|---|---|---|
| 2,591,159 | 4/1952 | Kabuss . | |
| 3,106,658 | 10/1963 | Chandler et al. . | |
| 3,330,979 | 7/1967 | Constanitine . | |
| 3,356,879 | 12/1967 | Rennick . | |
| 3,404,228 | 10/1968 | McLeod, Jr. et al. . | |
| 3,582,848 | 6/1971 | Ryder . | |
| 4,064,543 | 12/1977 | Phillips et al. . | |
| 4,360,839 | 11/1982 | Ragland, Jr. et al. . | |
| 4,405,910 | 9/1983 | Ohstu . | |
| 4,536,729 | 8/1985 | Osinga . | |
| 4,992,697 | 2/1991 | Penninga et al. . | |
| 5,019,745 | 5/1991 | Deal et al. | 313/440 |
| 5,023,510 | 6/1991 | Groothoff . | |
| 5,036,246 | 7/1991 | Germani . | |
| 5,198,729 | 3/1993 | Powell | 313/479 X |
| 5,430,351 | 7/1995 | Yokota . | |
| 5,432,401 | 7/1995 | Satoh et al. | 313/440 |
| 5,475,282 | 12/1995 | Liao . | |
| 5,497,136 | 3/1996 | Wall . | |
| 5,550,522 | 8/1996 | Dekkers et al. . | |
| 5,592,045 | 1/1997 | Dossot et al. . | |
| 5,696,425 | 12/1997 | Moore | 335/210 X |
| 5,729,304 | 3/1998 | Lim | 313/440 X |

*Primary Examiner*—Ashok Patel
*Attorney, Agent, or Firm*—Robert E. Bushnell, Esq.

[57] ABSTRACT

A tilt coil is mounted in front of a deflection yoke of a cathode-ray tube in order to perform a tilt function and an earth magnetic field compensation function, in a tilt coil mounting device of a display. And more particularly speaking, an improved tilt coil mounting device of a display can make the tilt coil fixed around a bulb of the cathode ray tube at a fixed interval by a tilt fixing member separately provided in order to amicably mount the tilt coil, and fully perform tilt and earth magnetic field compensation functions. In the display of the present invention comprising the cathode ray tube for producing an image, and the tilt coil for performing the tilt and earth magnetic field functions, the tilt coil is wound on the external circumference of the body of a spool, is mounted around the bulb of the cathode ray tube in front of the deflection yoke by means of the tilt coil fixing member having the body where the tilt coil is coiled, and a plurality of the supports extending from the body for fixing elastically, thereby easily mounting the tilt coil and amicably performing the tilt or earth magnetic field compensation function.

22 Claims, 6 Drawing Sheets

Fig. 1A
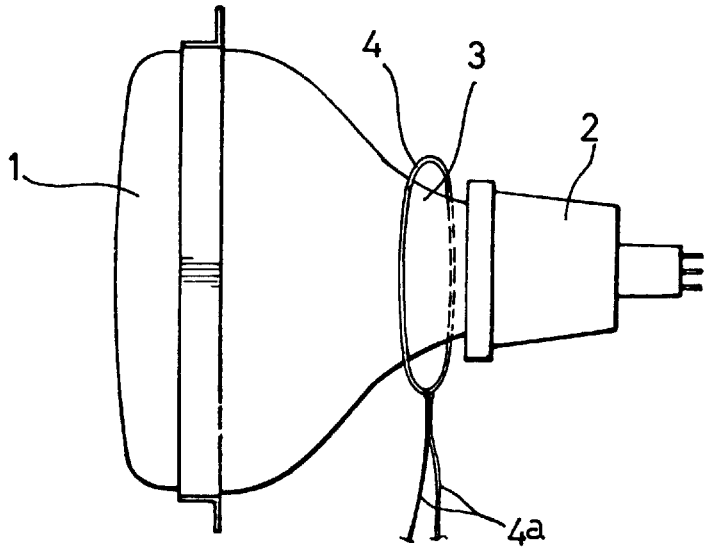
Fig. 1C
Fig. 1B
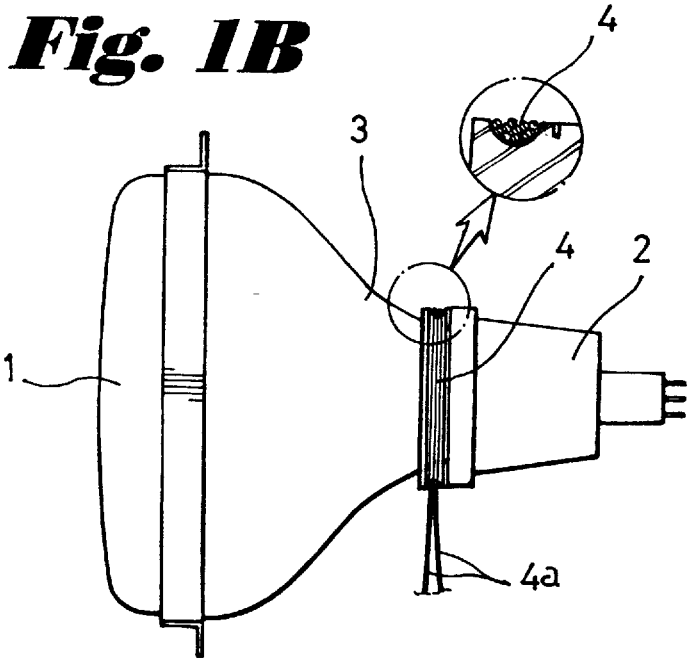

DEFLECTION YOKE MOUNTING DEVICE OF THE SPRAY

CLAIM FOR PRIORITY

This application makes reference to, incorporates the same herein, and claims all benefits accruing under 35 U.S.C. §119 from an application for Tilt Coil Mounting Device Of Display earlier filed in the Korean Industrial Property Office on the $28^{th}$ of Mar. and $2^{nd}$ of May 1996, and there duly assigned Serial Nos. 96-6253 and 96-10498 respectively.

BACKGROUND OF THE INVENTION

1. Technical Field

The present invention relates to a tilt coil mounted in front of a deflection yoke of a cathode-ray tube (hereinafter referred to as "CRT") in order to perform a tilt function and an earth magnetic field compensation function, and more particularly, to an improved tilt coil mounting device of a display which makes the tilt coil fixed around a bulb of the Cathode ray tube at a fixed interval by a tilt fixing member separately provided in order amicably to mount the tilt coil, and fully perform tilt and earth magnetic field compensation functions.

2. Related Art

Generally, a cathode ray tube has a neck portion fitted with a deflection yoke for directing an electron beam to an external circumference in a predetermined direction, and an electron gun for emitting a predetermined electron beam to a predetermined part of internal circumference; a funnel portion formed in front of the deflection yoke; and a panel portion for producing a predetermined image. Early efforts to compensate for deflections produced in a particular cathode ray tube attributable to factors such as idiosyncracies of the structure of the tube and non-linear conditions in deflections circuits included the Magnetic Means For Producing Compensations And Other Effects In A Cathode Ray Tube of N. G. Kabuss, U.S. Pat. No. 2,591,159, relied upon permanent magnets that were adjustably supported on a ring structure encircling the neck of the cathode ray tube, adjacent to the region where electrons pass after being deflected by the normal deflection coil, and the Magnetic Compensator of J. G. Chandler, U.S. Pat. No. 3,106,658, which endeavored to improve color registration using a ferromagnetic yoke encircling a color tube between its deflection system and its color-selection barrier.

The art disclosed by Robert J. Powell in U.S. Pat. No. 5,198,729 for CRT Monitor With Elimination Of Unwanted Time Variable Electric Field, when a cathode ray tube is manufactured the funnel portion of the Cathode ray tube is coated with a conductor, and then a magnetic field is formed by the conductor applied with an electric current, in order to perform tilt or earth magnetic field compensation functions. There have been some problems heretofore that have prevented various kinds of cathode ray tubes from being equipped with a tilt coil in this manner. Therefore, the method of using the tilt coil has been practiced as another means to perform tilt or earth magnetic field compensation functions.

In one technique commonly used in contemporary art, a tilt coil is simply coiled around the bulb portion of the tube in front of the deflection yoke. There are still some problems in this technique however, because a constant tilt function can not be performed due to the irregular coil of the tilt coil coiled on the Cathode ray tube, and that the tilt efficiency deteriorates because of the tilt coil without being fixed in position tends to slant to one side as a result of any impact on the product. In another contemporary technique, a tilt coil is wound around the front side of the deflection yoke. When the tilt coil is integrally coiled with the deflection yoke however, the tilt coil is not properly positioned around the exterior of the Cathode ray tube. As a result, the tilt and earth magnetic field functions are deleteriously compromised. Additionally, because the tilt coil should be coiled after the deflection yoke is formed, mounting of the tilt coil is troublesome and difficult to manufacture.

Dossot, et al., Auxiliary Coil Fastener In A Deflection Yoke, U.S. Pat. No. 5,592,045, advocates an auxiliary deflection coil mounted on a support ahving an opening disposed around the neck of the cathode ray tube, for modifying the main deflection field created by the main deflection coil. A separator is used for mounting the main and auxiliary deflection coils. This type of structure depends upon a plurality of positioning studs and adjustable feet to obtain satisfactory placement of the auxiliary coils.

SUMMARY OF THE INVENTION

Accordingly, it is therefore an object of the present invention to provide an improved process and spool for mounting a tilt coil around the neck of a cathode ray tube.

It is another object to provide a process and spool for mounting a tilt coil upon the necks of a wide variety of different shapes and sized of cathode ray tubes.

It is yet another object to provide a process and spool for quickly and accurately positioning a tilt coil around the neck of a cathode ray tube.

It is still another object to provide a process and spool for supporting a tilt coil amicably mounted around a bulb of a cathode ray tube, thereby enabling full performance of tilt and earth magnetic field compensation functions of the cathode ray tube.

It is still yet another object to provide a process and spool enabling easy installation of an annular electrically conducting coil coaxially with, and radially spaced apart from the neck of a cathode ray tube.

It is also an object to provide a process and spool that may be easily installed around the neck of a cathode ray tube to support an annularly wound electrically conducting coil in a resilient, radially spaced apart relation with the neck of the tube while the spool is resiliently supported by the frame of a yoke coaxially installed axially spaced apart along the neck of the tube.

To achieve these and other advantages and in accordance with the purpose of the present invention, as embodied and broadly described, a tilt coil fixing member which is a molding, is provided in order to fix the tilt coil at a fixed interval around the bulb in front of the deflection yoke of the cathode ray tube. A mount for a tilt coil constructed according to the principles of the present invention contemplates a spool constructed as a ring-shaped body with a hollow center, and either a coil groove or coiled side on which the tilt coil is wound, formed as an integral feature of the body. The deflection yoke functions as a supporting body. A plurality of elastic arms are located at fixed intervals around the circumference of the body so that the spool is attached to and supported by the frame of the deflection yoke in conjunction with the resiliency of the arms. The tilt coil is wound with a coil winder on the external circumference of the body, and is mounted around the bulb of the cathode ray tube in front of the deflection yoke by means of the plurality of elastic ribs supporting the spool. The spool is alternatively shaped either in the form of a groove into which the tilt coil is inserted, or a plurality of arcuately spaced apart radially outwardly projecting hooks. Accordingly, with installations of embodiments of the present invention on cathode ray tubes for producing variable visual images, the tilt coil compensates for tilt and earth based magnetic field functions.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

BRIEF DESCRIPTION OF THE DRAWINGS

A more complete appreciation of the present invention, and many of the attendant advantages thereof, will become readily apparent as the same becomes better understood by reference to the following detailed description when considered in conjunction with the accompanying drawings in which like reference symbols indicate the same or similar components, wherein:

FIG. 1A is a side view of a cathode-ray tube showing the mounting of a tilt coil on a cathode ray tube according to one technique practiced in the conventional art.

FIG. 1B is a side view of a cathode-ray tube showing the mounting of a tilt coil on a cathode ray tube according to another technique practiced in the conventional art.

DETAILED DESCRIPTION OF THE PREFERRED EMBODIMENT

Figure 2:
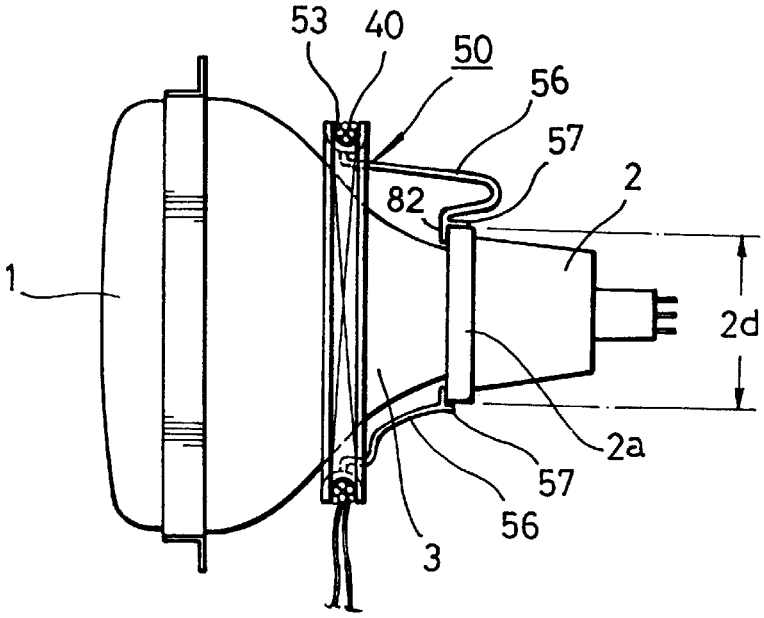
FIG. 2 is a side view of a cathode-ray tube showing a tilt coil mounted on a spool constructed as a first embodiment according to the principles of the present invention.
Figure 3:
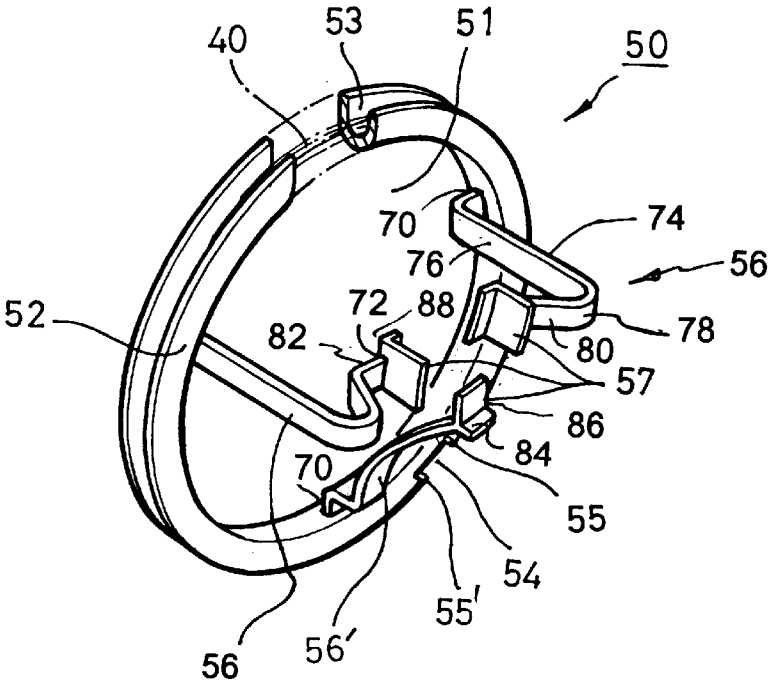
FIG. 3 is a perspective view of the spool for tilt coil constructed as the first embodiment of the present invention.

Referring now to the drawings and particularly to FIG. 1A is one example of contemporary practice in the art in which the bulb portion 3 in front of the deflection yoke 2 is simply coiled with the tilt coil 4, an electric current is applied to the ends 4*a* of the coil, and then the magnetic field is formed at the tilt coil so that the tilt is controlled. There are still some problems in this technique however, because a constant tilt function can not be performed due to the irregular coil of the tilt coil coiled on the cathode ray tube, and that the tilt efficiency deteriorates because of the tilt coil without being fixed in position tends to slant to one side as a result of any impact on the product.

FIG. 1B illustrates another technique commonly practiced in the art for mounting a tilt coil. Tilt coil 4 is wound around the front side 2*a* of the deflection yoke 2, an electric current is applied to the ends 4*a* of tilt coil 4, and a magnetic field forms so that the tilt is controlled. When the tilt coil is integrally coiled with the deflection yoke, as shown by FIG. 1B, the tilt coil is not properly positioned around the exterior of bulb 3 of the cathode ray tube. As a result, the tilt and earth magnetic field functions are deleteriously compromised. Additionally, because the tilt coil should be coiled after the deflection yoke is formed, mounting of the tilt coil is troublesome and difficult to manufacture.

FIGS. 2 to 5 provide different views showing details describing a first embodiment of a tilt coil mounting apparatus of the present invention. Cathode ray tube 1 where a tilt coil is mounted, comprises a deflection yoke located at the back portion of a bulb 3 which makes up the cathode ray tube, and the tilt coil is mounted around the bulb 3. A tilt coil fixing member 50 which is a molding, is separately provided in order to fix the tilt coil, and the tilt coil fixing member 50 includes a ring-shaped body 52 having a central hollow 51 where the bulb 3 of the cathode ray tube 1 is inserted. A coil groove 53 is, as a coiling means, formed on the external circumference of the body 52 that the tilt coil 40 may be coiled, and the tilt coil 40 is coiled on the coil groove 53 by means of a coiling machine.

Figure 5:
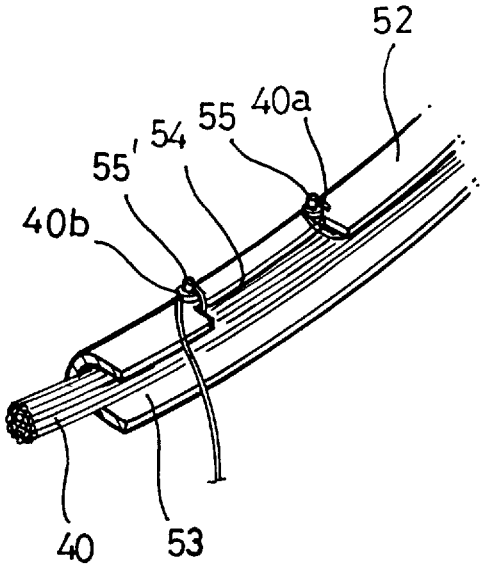
FIG. 5 is a magnified perspective view of "B" portion of FIG. 4A.

FIG. 5 in detail shows an auxiliary coiling means which is employed to amicably coil the tilt coil 40. The auxiliary coiling means includes a groove 54 located at one side of the body 52, communicating with the coil groove 53, a fixing projection 55 protruding from the side of the body 52, and a finishing projection 55' formed at an interval with the fixing projection 55. Accordingly, in case that the tilt coil 40 is coiled on the coil groove 53 of the body 52, the front end 40*a* of the tilt coil is wound on the fixing projection 55 to be fixed, the tilt coil is coiled on the coil groove 53 by a coiling machine just as much as set up, and then the back end 40*b* of the tilt coil is wound on the finishing projection 55' to be fixed. Therefore, the front and back ends 40*a* and 40*b* of the tilt coil are fixed on the fixing and finishing projections 55 and 55', respectively, so that the tilt coil 40 is not uncoiled.

Figure 4A:
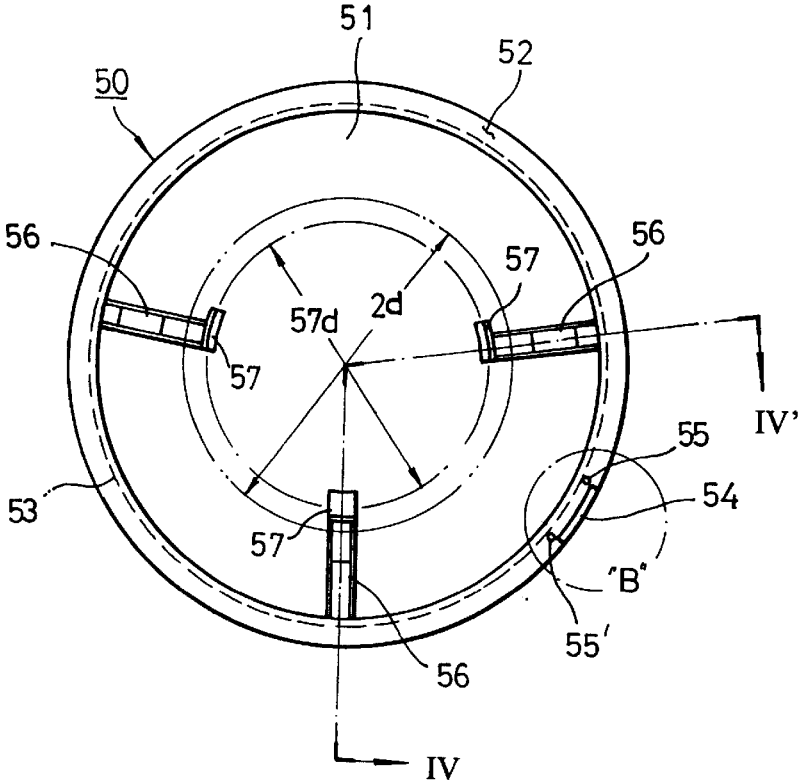
FIG. 4A is a front view of the spool for the tilt coil constructed as the first embodiment of the present invention.

Meanwhile, a plurality of arcuately spaced apart support arms 56, and a single arm 56' symmetrically positioned between arms 56, integrally extending from one side of the body 52 lengthwise, are formed at the tilt coil fixing member 50. The length of the support arms 56, 56' is longer than the thickness thereof so that the supports 56, 56' have an elastic force L-shaped fixing projections, or shoes, 57 are formed at the free distal ends of the support arms 56, 56', respectively, that the front end frame 2*a* forming the deflection yoke 2 may be fitted thereon. And at least three supports 56, 56' are formed at the same intervals, sloping to the center of the body 52, as shown in FIG. 4A. In a construction of at least three support arms 56, 56', the diameter 57*d* of the supports' free ends should be shorter than the frame diameter 2*d* of the deflection yoke 2. The diameter 57*d* of the supports' free ends is based on shoes 57 provided at the free distal ends of support arms 56, 56'. Each of resilient arms 56 hold spool 50 axially spaced apart from yoke 2 surrounding the neck of tube 1. Shoes 57 are constructed with two intersecting flanges 84, 86 defining a junction 88.

Each of arms 56 is formed arcuately spaced apart around an arc including less than one-half of the circumference of spool 50, and extends approximately axially outwardly from a first side of spool 50. Each arm 56 has a proximal end 70 joining spool 50, a distal end 72 bearing a corresponding one of shoes 57, and an elongate member 74 joining proximal end 70 and distal end 72. Each of elongate members 74 has a continuous length made with a first linear section 76 extending axially outwardly in a first direction from a corresponding proximal end 70, a curved section 78 forming a transition from first linear section 76 to a second linear section 80 extending in a second and approximately opposite direction toward central hollow 51, and a terminal section 82 extending radially inwardly between second linear section 80 and a corresponding one of shoes 57. Elongate members 74 give an orientation to corresponding one of shoes 57 with a first one of the intersecting flanges 84 extending outwardly parallel to the central axis of spool 50 from central hollow 50 to embrace an exterior circumferential portion of yoke 2 while a second one of intersecting flanges 86 extends radially inwardly toward the central axis from the junction 88 between flanges 84, 86 to embrace a base surface of yoke 2. The second resilient arm 56' has a first end 90 joining spool 50, a second end 92 supporting one of shoes 57 with the same orientation to yoke 2, and an intermediate member 94 joining first end 90 to second end 92.

Figure 4B:
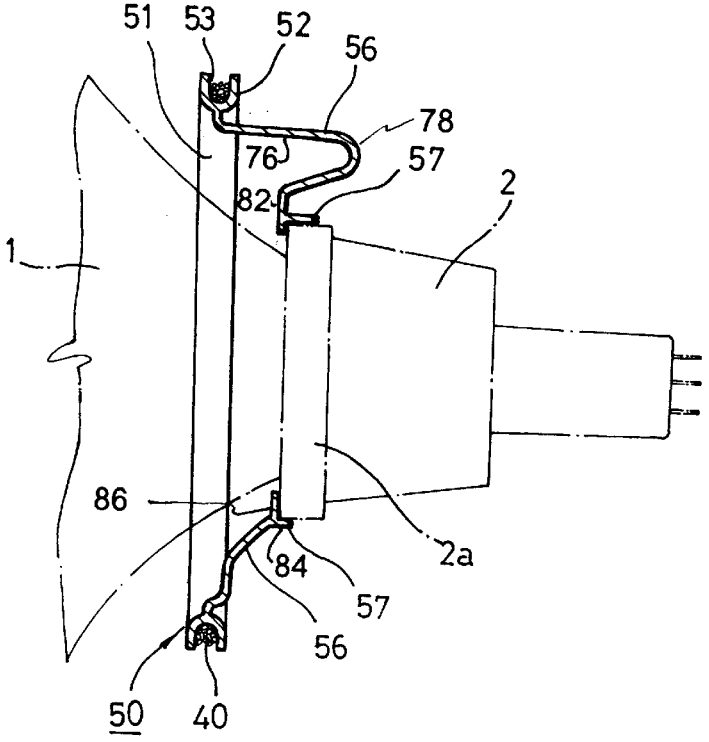
FIG. 4B is a cross-sectional view taken along sectional line IV—IV' in FIG. 4A.

As shown in FIG. 4B, in the tilt coil fixing member 50 where the tilt coil 40 is coiled, shoes 57 are fitted on the frame 2*a* of the deflection yoke 2. Here, as shoes 57 are fitted on the frame 2*a* with the free ends' diameter 57*d* widening outwardly, a repelling elasticity acts on the frame 2*a* as much as arms 56, 56' are compulsorily widened outwardly. As a result, the tilt coil fixing member 50 is fixed, where the tilt coil 40 is located around the bulb 3 by means of support arms 56, 56'.

When the bulb 3 of cathode ray tube 1 is inserted into the central hollow 51 of the tilt coil fixing member 50 fixed at the deflection yoke 2, only one tilt coil fixing member can be installed because the length of the diameter of central hollow 51 is properly altered. Therefore, there is no need to manufacture properly the respective tilt coil fixing members in accordance with the size or kind of cathode ray tube 1. In addition, because the support arms 56, 56' fixed at the deflection yoke 2, widen elastically, they can be fixed irrespective of the size of the deflection yoke. Thus, only one spool 50 can be readily installed on a broad variety of sizes and shaped of cathode ray tubes, regardless of the size alteration of the deflection yoke and cathode ray tube. Spool 50, shoes 57, and resilient arms 56, 56' may be formed as a single integrated monolithic structure made of an elastic material.

Figure 6:
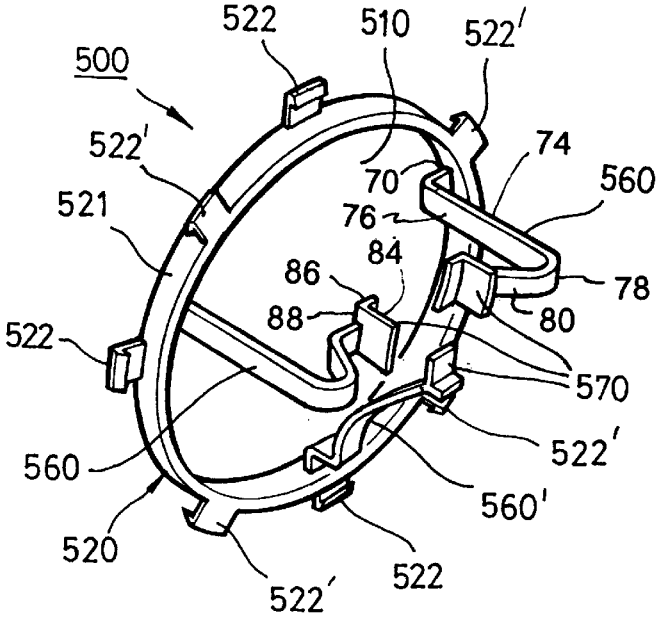
FIG. 6 is a perspective view of the spool for tilt coil constructed as a second embodiment of the present invention.
Figure 7A:
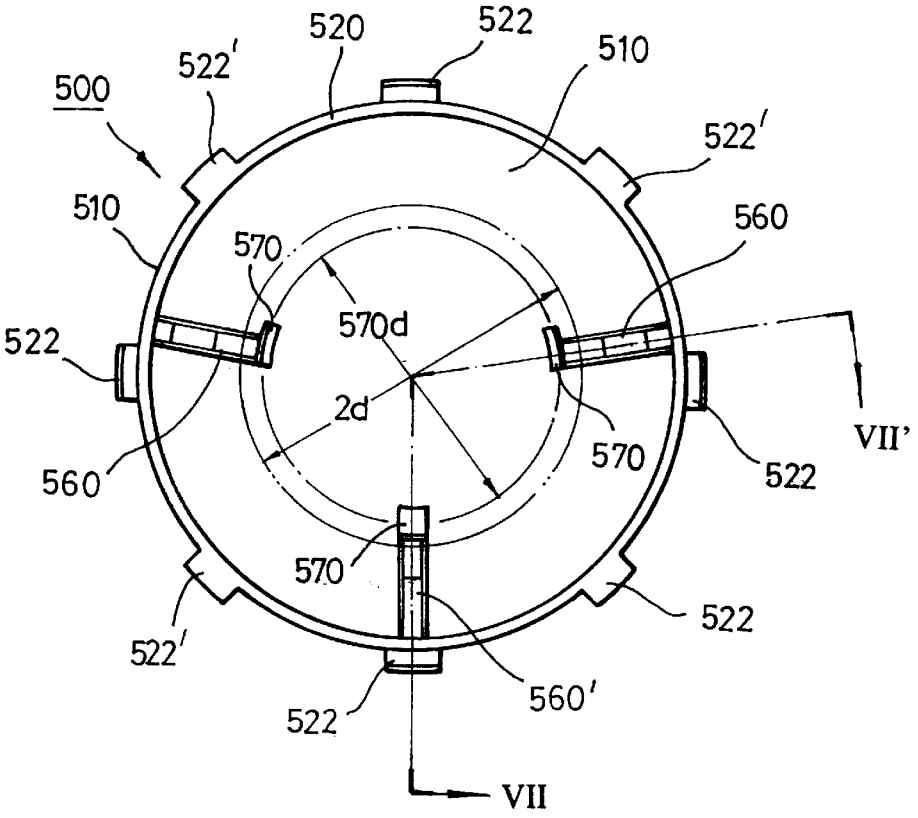
FIG. 7A is a front view of the spool for the tilt coil constructed as the second embodiment of the present invention.
Figure 7B:
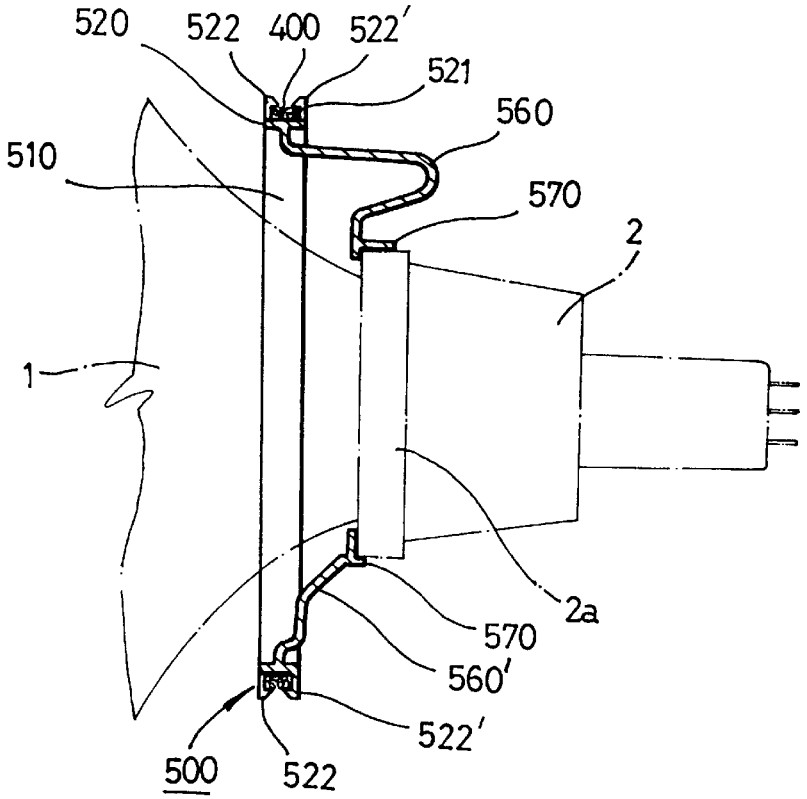
FIG. 7B is a cross-sectional view taken along sectional line VII—VII' of FIG. 7A.
Figure 8:
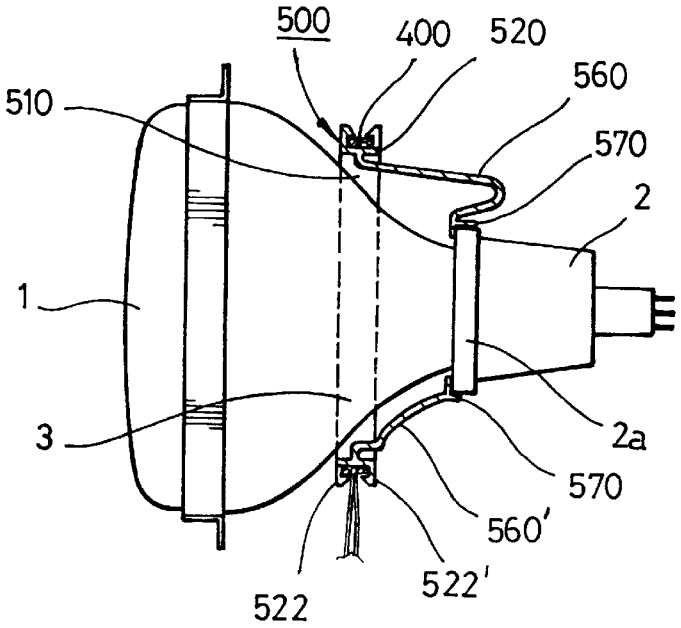
FIG. 8 is a side view of a cathode-ray tube showing a tilt coil mounted on a spool constructed as a second embodiment according to the principles of the present invention.

FIGS. 6 to 8 show the tilt coil fixing member 500 according to the second embodiment of the present invention. The construction of the tilt coil fixing member 500 is essentially identical to that of the tilt coil fixing member 50 according to the first embodiment. That is, it includes the central hollow 510, the body 520, support arms 560, 560', and the fixing projections 570 that also serve as the free ends of support arms 560, 560' and the free ends' diameter 570*d* is shorter than the frame diameter 2*d* of the deflection yoke 2. Therefore, the detailed explanation of the construction and operation of the tilt coil fixing member is omitted herein. Unlike the coiling means of the first embodiment, however, in the coiling means of the second embodiment, coil deviation preventing hooks 522 and 522' with a fixed elastic force are integrally formed with both sides of the coiled side 521 which is an external circumference of the body 520 so that the tilt coil 400 coiled on the body 520, does not separate from the body 520. And a plurality of the hooks protruding are formed at the same intervals on the whole surface of the body. Therefore, when the coiled side 521 of the body 520 is coiled with the tilt coil 400 by means of a coiling machine, the tilt coil 400 is mounted inside the coil deviation preventing hooks 522 and 522'.

FIG. 8 is the second embodiment of the present invention, in which the tilt coil fixing member 500 is fixed, and the explanation of the elastic fixation contributed by support arms 560, 560' is omitted herein because it is identical with the first embodiment. As mentioned above, the tilt coil is fixed simply, firmly, and easily around the bulb of the cathode ray tube according to the present invention so that the productivity can be enhanced. Also, the tilt coil is mounted at the correct place where the bulb of the cathode ray tube is located so that the tilt or earth magnetic field function is fully performed, and product performance is greatly enhanced. In addition, even if the size of the deflection yoke and cathode ray tube is altered, the present invention can be installed in accordance with the alteration, thereby decreasing the cost of manufacture.

It will be apparent to those skilled in the art that various modifications and variations can be made in a tilt coil mounting device of a display of the present invention without departing from the spirit or scope of the invention. Thus, it is intended that the present invention cover the modifications and variations of this invention provided they come within the scope of the appended claims and their equivalents.

While there have been illustrated and described what are considered to be preferred embodiments of the present invention, it will be understood by those skilled in the art that various changes and modifications may be made, and equivalents may be substituted for elements thereof without departing from the true scope of the present invention. In addition, many modifications may be made to adapt a particular situation to the teaching of the present invention without departing from the central scope thereof. Therefore, it is intended that the present invention not be limited to the particular embodiment disclosed as the best mode contemplated for carrying out the present invention, but that the present invention includes all embodiments falling within the scope of the appended claims.

What is claimed is:

1. A mounting, comprising:

a continuous circular spool exhibiting a central hollow disposed around an axis to coaxially accommodate insertion of a neck of a cathode ray tube, said spool being comprised of a circumference exhibiting an inner circumferential surface and an outer circumferential surface coaxially disposed around said axis;

a plurality of shoes formed with intersecting flanges defining a junction;

a plurality of first resilient arms arcuately spaced apart around an arc including less than one-half of said circumference, extending approximately axially outwardly from a first side of said spool, each of said first resilient arms comprising a proximal end joining said spool, a distal end bearing a corresponding different one of said shoes, and an elongate member joining said proximal end and said distal end;

said plurality of first resilient arms holding said spool axially spaced apart from a yoke surrounding the neck;

each of said elongate members having a continuous length comprised of a first linear section extending axially outwardly in a first direction from a corresponding said proximal end, a curved section forming a transition from said first linear section to a second linear section extending in a second and approximately opposite direction toward said central hollow, and a terminal section extending radially inwardly between said second linear section and a corresponding one of said shoes;

each of said elongate members giving an orientation to said corresponding one of said shoes with a first one of said intersecting flanges extending outwardly parallel to said axis from said central hollow to embrace an exterior circumferential portion of the yoke while a second one of said intersecting flanges extends radially inwardly toward said axis from said junction to embrace a base surface of the yoke; and a second resilient arm having a first end joining said spool, a second end supporting one of said shoes with said orientation, and an intermediate member joining said first end to said second end.

2. The mounting of claim 1, further comprised of said spool, said plurality of shoes, said plurality of first resilient arms, and said second resilient arm formed as a single integrated monolithic structure made of an elastic material.

3. The mounting of claim 1, further comprised of said plurality of first resilient arms in cooperation with said second resilient arm, maintaining said spool spaced apart from the neck of the cathode ray tube.

4. The mounting of claim 1, further comprised of said spool having a pair of spaced apart circular flanges joined by an U-shaped web accommodating a coil of an electrically conductor wound coaxially with said axis between said circular flanges.

5. The mounting of claim 1, with said spool further comprising:

a first plurality of arcuately spaced apart detents extending radially outward from a first side of said outer circumferential surface; and a second plurality of arcuately spaced apart detents extending radially outwardly from a second side of said outer circumferential surface, with detents in said first plurality of detents being arcuately offset from detents in said second plurality of detents;

said outer circumferential surface accommodating a coil of an electrical conductor wound coaxially with said axis between said first plurality of detents and said second plurality of detents.

6. The mounting of claim 1, further comprised of said second resilient arm being symmetrically positioned relative to said plurality of first resilient arms.

7. A mounting, comprising:

a continuous circular spool exhibiting a central hollow disposed around an axis to coaxially accommodate insertion of a neck of a cathode ray tube, said spool being comprised of a circumference exhibiting an inner circumferential surface and an outer circumferential surface coaxially disposed around said axis;

a plurality of shoes formed with intersecting flanges defining a junction;

a plurality of first resilient arms arcuately spaced apart around an arc including less than one-half of said circumference, extending approximately axially outwardly from a first side of said spool, each of said first resilient arms comprising a proximal end joining said spool, a distal end bearing a corresponding different one of said shoes, and an elongate member joining said proximal end and said distal end;

said plurality of first resilient arms holding said spool axially spaced apart from a yoke surrounding the neck;

each of said elongate members giving an orientation to said corresponding one of said shoes with a first one of said intersecting flanges extending outwardly parallel to said axis from said central hollow to embrace an exterior circumferential portion of the yoke while a second one of said intersecting flanges extends radially inwardly toward said axis from said junction to embrace a base surface of the yoke; and a second resilient arm disposed in a symmetric relation to said plurality of first resilient arms, said second resilient arm having a first end joining said spool, a second end supporting one of said shoes with said orientation embracing the yoke, and an intermediate member joining said first end to said second end.

8. The mounting of claim 7, further comprised of each of said elongate members having a continuous length comprised of a first linear section extending axially outwardly from said spool in a first direction from a corresponding said proximal end, a curved section forming a transition from said first linear section to a second linear section extending in a second and approximately opposite direction toward said central hollow, and a terminal section extending radially inwardly between said second linear section and a corresponding one of said shoes.

9. The mounting of claim 7, further comprised of said spool, said plurality of shoes, said plurality of first resilient arms, and said second resilient arm formed as a single integrated monolithic structure made of an elastic material.

10. The mounting of claim 7, further comprised of said plurality of first resilient arms in cooperation with said second resilient arm, maintaining said spool spaced apart from the neck of the cathode ray tube.

11. The mounting of claim 7, further comprised of said spool having a pair of spaced apart circular flanges joined by an U-shaped web accommodating a coil of an electrically conductor wound coaxially with said axis between said circular flanges.

12. The mounting of claim 7, with said spool further comprising:

a first flange extending radially outwardly from a first side of said outer circumferential surface; and a second flange extending radially outwardly from a second side of said outer circumferential surface;

said outer circumferential surface accommodating a coil of an electrical conductor wound coaxially with said axis between said first flange and said second flange.

13. The mounting of claim 12, further comprising:

said first flange extending circularly around said first side of said outer circumferential surface; and said second flange extending circularly around said second side of said outer circumferential surface.

14. The mounting of claim 12, further comprising:

a third flange spaced arcuately apart from said first flange, extending radially outwardly from said first side;

a fourth flange spaced arcuately apart from said second flange, extending radially outwardly from said second side; and said first flange and said third flange being arcuately offset from said second and said fourth flange.

15. The mounting of claim 12, further comprising:

said first flange comprising a first plurality of arcuately spaced apart detents; and said second flange comprising a second plurality of arcuately spaced apart detents arcuately offset from detents in said first plurality of detents.

16. A mounting, comprising:

a continuous circular spool exhibiting a central hollow disposed around an axis to coaxially accommodate insertion of a neck of a cathode ray tube, said spool being comprised of a circumference exhibiting an inner circumferential surface and an outer circumferential surface coaxially disposed around said axis;

a plurality of shoes formed with intersecting flanges defining a junction;

a plurality of first resilient arms having distal ends terminated by different ones of said shoes arcuately spaced apart around an arc including less than one-half of said circumference, extending approximately axially outwardly from a first side of said spool and holding said spool radially spaced apart from the neck and axially spaced apart from a yoke surrounding the neck; and a second resilient arm having a first end joining said spool, a second end supporting one of said shoes with said orientation, and an intermediate member joining said first end to said second end.

17. The mounting of claim 16, further comprised of said spool, said plurality of shoes, said plurality of first resilient arms, and said second resilient arm formed as a single integrated monolithic structure made of an elastic material.

18. The mounting of claim 16, with each of said arms having a continuous length comprised of:

a first linear section extending axially outwardly in a first direction from a corresponding said proximal end, a second linear section extending in a second and approximately opposite direction toward said central hollow;

a curved section forming a transition between said first linear section and said second linear section; and a terminal section extending radially inwardly between said second linear section and a corresponding one of said shoes;

each of said elongate members giving an orientation to a corresponding one of said shoes with a first one of said intersecting flanges extending outwardly parallel to said axis from said central hollow to embrace an exterior circumferential portion of the yoke while a second one of said intersecting flanges extends radially inwardly toward said axis from said junction to embrace a base surface of the yoke.

19. The mounting of claim 16, further comprised of said spool having a pair of spaced apart circular flanges joined by an U-shaped web accommodating a coil of an electrically conductor wound coaxially with said axis between said circular flanges.

20. The mounting of claim 19, further comprised of said spool, said plurality of shoes, said plurality of first resilient arms, said second resilient arm, said pair of circular flanges, and said web being formed as a single integrated monolithic structure made of an elastic material.

21. The mounting of claim 16, with said spool further comprising:

a first plurality of arcuately spaced apart detents extending radially outward from a first side of said outer circumferential surface; and a second plurality of arcuately spaced apart detents extending radially outwardly from a second side of said outer circumferential surface, with detents in said first plurality of detents being arcuately offset from detents in said second plurality of detents;

said outer circumferential surface accommodating a coil of an electrical conductor wound coaxially with said axis between said first plurality of detents and said second plurality of detents.

22. The mounting of claim 21, further comprised of said spool, said plurality of shoes, said plurality of first resilient arms, said second resilient arm, said first plurality of detents, and said second plurality of detents being formed as a single integrated monolithic structure made of an elastic material.

* * * * *